United States Patent [19]

Winans

[11] 4,236,671

[45] Dec. 2, 1980

[54] RAILROAD RAIL HOLDER

[76] Inventor: Ralph P. Winans, P.O. Box 194, Dallesport, Wash. 98617

[21] Appl. No.: 3,547

[22] Filed: Jan. 15, 1979

[51] Int. Cl.[3] ..... E01B 3/00; E01B 9/00

[52] U.S. Cl. ..... 238/39; 238/38; 238/55; 238/288; 238/339

[58] Field of Search ..... 238/38, 121, 59, 60, 238/61, 99, 264, 288, 299, 339, 350, 55, 56, 39, 76, 95, 96, 101, 275, 276, 278, 306, 307, 331

[56] References Cited

U.S. PATENT DOCUMENTS

| | | | |
|---|---|---|---|
| 744,285 | 11/1903 | Black | 238/350 X |
| 1,047,367 | 12/1912 | Anglus | 238/99 |
| 1,063,775 | 6/1913 | Clark | 238/99 |
| 1,132,155 | 3/1915 | Bodine | 238/350 X |
| 1,324,698 | 12/1919 | Shovestul | 238/339 X |
| 1,398,385 | 11/1921 | McConoughey | 238/299 X |
| 1,620,730 | 3/1927 | Mitchell | 238/38 |
| 1,747,054 | 2/1930 | Cox | 238/38 |
| 2,128,272 | 8/1938 | Stackhouse | 238/38 X |
| 2,453,132 | 11/1948 | Jones | 238/38 |

*Primary Examiner*—Randolph A. Reese

*Attorney, Agent, or Firm*—Eugene D. Farley

[57] ABSTRACT

A tie cap rail holder for securing a railroad rail to its supporting tie comprises a cap dimensioned to seat gravitationally over the top of the tie in a restricted, longitudinally slidable fit. The cap has on its upper surface a rail seat dimensioned to receive the rail base. On one side of the rail seat an upwardly and inwardly extending detent is dimensioned and positioned for engaging and retaining the adjacent side margin of the rail base. A plurality of the holders are adapted for opposite placement on adjacent ties, with their respective detents engaging opposite side margins of the rail base, thereby securing the rail to the ties.

5 Claims, 2 Drawing Figures

RAILROAD RAIL HOLDER

BACKGROUND AND GENERAL STATEMENT OF THE INVENTION

This invention relates to railroad rail holders. It relates particularly to railroad rail holders of the class comprising a tie cap adapted for gravitational seating on the tie and provided with means for securing the rail to the holder.

As is well known, railroad rails conventionally are secured to the underlying ties by means of tie plates and spikes. As is also well known, driving the spikes into the ties damages the wood immediately surrounding the spikes and provides an entryway for rain water and surface water. As a result, with the passage of time, the wood deteriorates and rots and the spikes become loose. The stresses and vibrations of the superimposed rails exaggerate and accelerate this problem.

As a result, the railroads are placed under the necessity of inspecting the rails frequently, maintaining the spikes in a tightly driven condition, and from time to time replacing the rotted ties.

Prior art patents which address themselves to this problem include the following:

| Patent No. | Inventor | Title |
|---|---|---|
| 1,790,889 | Waltemate, H. | COMBINATION RAILWAY TRACK CLAMP |
| 2,018,658 | Boyce, W. S. | TIE PLATE |
| 2,370,715 | Carmichael, J. B. | RAILROAD TIE |
| 2,410,260 | Boland, E. J. | TIE PLATE AND RAIL ANCHOR ASSEMBLY |
| 2,645,427 | Naud, C. | RAIL FASTENING MEANS |
| 3,837,572 | VanSant, A. D. | RAIL ANCHOR |
| 4,071,191 | Hutton, C. M. | TIE PLATE FASTENERS SYSM. |

None of the foregoing prior art rail holders satisfactorily meets all of the problems attending the mounting of railroad rails on their underlying ties and it accordingly is the general purpose of the present invention to provide such a rail holder which, specifically stated, is characterized by the following distinguishing features and advantages:

(1) Eliminates the necessity for using spikes.
(2) Overlies the ties, thereby sheltering and preserving them.
(3) Easy to install.
(4) Holds the rails securely and preserves their alignment in use.
(5) Distributes the load and stresses uniformly over the entire body of the tie.
(6) Requires but little maintenance.
(7) What maintenance is required does not involve the use of expensive maintenance machinery.
(8) Produces substantial operational economies.

In its broad aspect, the rail holder of my invention which provides the foregoing and other advantages comprises a cap dimensioned to seat gravitationally over the top of the tie in a restricted, longitudinally slidable fit. The cap has on its upper surface a rail seat dimensioned to receive the rail base. On one side of the rail seat is an inwardly and upwardly extending detent dimensioned and positioned for engaging and retaining the adjacent side margin of the rail base. A plurality of the holders is adapted for opposite placement on adjacent ties, with their respective detents engaging opposite side margins of the rail base. When thus in place, the rail is retained securely on the ties without the necessity of using spikes with their attendant disadvantages.

DESCRIPTION OF A SPECIFIC EMBODIMENT OF THE INVENTION

Figure 2:
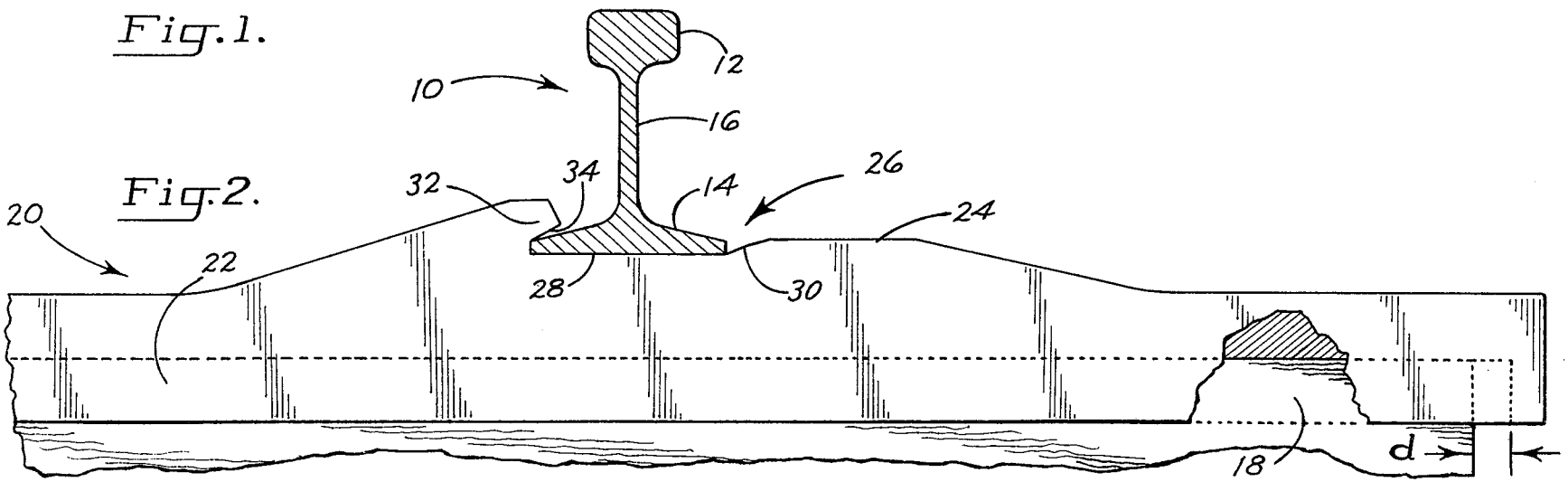
FIG. 2 is a fragmentary sectional view taken along the line 2—2 of FIG. 1 and illustrating particularly the manner of mounting each rail on a rail holder.

As illustrated particularly in FIG. 2, the rail holder of my invention is adapted for use with a conventional railroad rail indicated generally at 10 and comprising a running or rail portion 12, a base 14 and a vertical connecting web 16. The rail is supported in the usual manner on a plurality of spaced wooden ties 18. Although the ties conventionally are creosoted or otherwise treated with preservatives, they are subject to deterioration with use and upon exposure to the elements, as explained above, particularly when penetrated by rail-retaining spikes.

The presently described tie holder is indicated generally at 20. It consists of a cap made of iron alloy or steel of sufficient gauge and strength to withstand the stresses to which it is subjected in use. It includes a top plate and a peripheral skirt 22 depending from the top plate, as illustrated.

The cap is dimensioned to seat gravitationally over the top of the tie in a restricted, longitudinally slidable fit. To this end it is made longer than the tie which it covers by an increment "d". The measure of this increment is determined by the installation requirement of the rails on the rail holder. In a typical instance, the interior longitudinal dimension of the cap may be about an inch longer than the length of the standard nine foot railroad tie.

Formed integrally with the skirt or body portion 22 of the rail holder are two longitudinally spaced raised portions 24, one for each rail. Each of these is formed with a rail seat indicated generally at 26.

The rail seat includes a central flat 28 which is depressed to provide a rail-retaining segment 30 on one side of the rail. This segment has a downwardly and inwardly sloping rail guiding surface to facilitate mounting of the rail on the rail seat.

On the opposite side of the seat there is provided a detent 32. This is angled inwardly and upwardly. Its undersurface 34 is sloping. It thus provides a recess which receives the margin of the rail base.

The FIG. 2 illustration pictures the construction and arrangement of the rail seat on one end of the tie cap holder. The construction and arrangement of the companion seat on the other end is the same. It accordingly will be noted that detent 32 associated with one of the seats engages the rail base on the inside of the rail while that associated with the seat on the other end of the holder engages the outside margin of the rail base.

This makes possible mounting the rails using but the single class of tie cap, i.e. without the necessity of providing rights and lefts.

Figure 1:
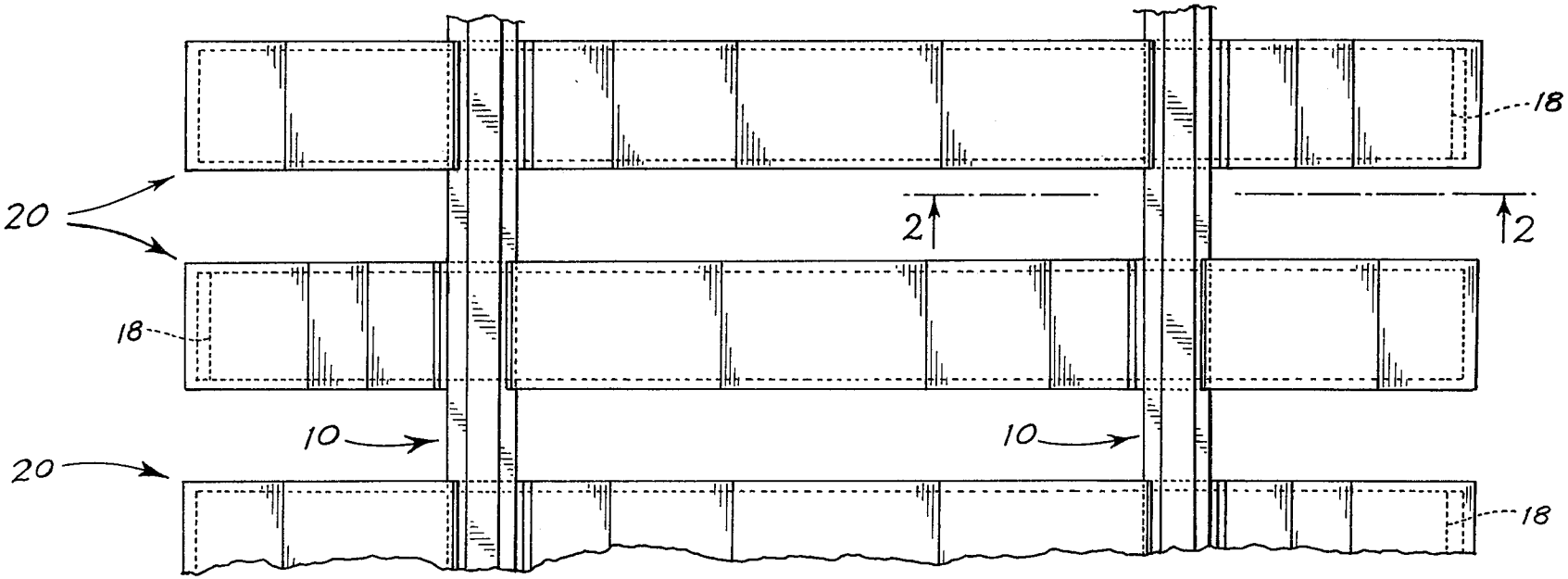
FIG. 1 is a plan view of a railroad rail installation illustrating a railroad track mounted on ties using the rail holders of my invention.

The manner of mounting the rails is illustrated in FIG. 1.

First the tie caps are placed over the ties. Next the rail is lowered into position on the rail seats of each tie cap with the tie cap positioned so that its detents 32 do not interfere. After the rail is located on the rail seats, the tie cap is tapped to shift its longitudinal position until the detents overlie one margin of the rail base, as illustrated in FIG. 2. Sloping, guiding surfaces 30 on the opposite sides of the rail seats assist in this operation. Adjacent tie caps are tapped in opposite directions to engage the rail on opposite sides.

Although the tie caps thus are longitudinally shiftable, the tolerances are so close and the weight of the rails so great that the rails are maintained in use in their operative upright position. This is accomplished solely by the tie caps, which need not be secured to the ties by means of spikes, but remain in place gravitationally. The disadvantages attending the use of spikes thus are eliminated.

Having thus described my invention in preferred embodiments, I claim as new and desire to protect by Letters Patent:

1. A rail holder for securing a railroad rail to its supporting ties, wherein the rail includes a base having side margins, the holder comprising:

(a) a cap having a top plate and a depending peripheral skirt, the cap being dimensioned to seat gravitationally over the top of a tie with the depending peripheral skirt lapping the sides and ends of the tie in a longitudinally restricted but slidable fit, (b) the top plate of the cap having on its upper surface a rail seat dimensioned to receive the base of a rail, and (c) on one side of the rail seat an inwardly and upwardly extending detent dimensioned and positioned for engaging and retaining a side margin of the base of a rail, (d) a plurality of the holders being adapted for opposite placement on adjacent ties, with their respective detents engaging the opposite side margins of the base of a rail.

2. The rail holder of claim 1 including a rail base retainer extending upwardly from the rail seat on the side thereof opposite the detent.

3. The rail holder of claim 2 wherein the rail base retainer is downwardly and inwardly sloped toward the rail seat to provide a guiding surface for seating a rail during its installation.

4. The rail holder of clalm 1 wherein the detent is upwardly and inwardly inclined to provide a recess dimensioned to receive the base of a rail.

5. The rail holder of claim 1 including a rail base retainer extending upwardly and outwardly from the rail seat on the side thereof opposite the detent and forming a sloping rail guiding surface on the side opposite the detent for seating rails during installation, and wherein the detent is upwardly and inclined to provide a recess dimensioned to receive the base of a rail.

* * * * *